United States Patent [19]

Vialaneix

[11] Patent Number: 5,015,984

[45] Date of Patent: May 14, 1991

[54] IGNITION COIL, IN PARTICULAR FOR AN INTERNAL COMBUSTION ENGINE OF AN AUTOMOTIVE VEHICLE, AND MEANS FOR RETAINING THE PRIMARY ASSEMBLY WITHIN THE SECONDARY ASSEMBLY OF SUCH A COIL

[75] Inventor: Dominique Vialaneix, Issoire, France

[73] Assignee: Valeo Electronique, Voisins-le-Bretonneux, France

[21] Appl. No.: 510,821

[22] Filed: Apr. 18, 1990

[30] Foreign Application Priority Data

Apr. 28, 1989 [FR] France ..... 89 05641

[51] Int. Cl.[5] ..... H01F 27/30

[52] U.S. Cl. ..... 336/197; 336/198

[58] Field of Search ..... 336/198, 208, 178, 192, 336/185, 197; 310/194

[56] References Cited

U.S. PATENT DOCUMENTS

| | | | |
|---|---|---|---|
| 4,250,479 | 2/1981 | Bausch et al. | 336/208 |
| 4,763,094 | 8/1988 | Kojima | 336/178 |

FOREIGN PATENT DOCUMENTS

| | | | |
|---|---|---|---|
| 0138014 | 4/1985 | European Pat. Off. . | |
| 0230811 | 8/1987 | European Pat. Off. . | |
| 2006736 | 8/1971 | Fed. Rep. of Germany . | |
| 2311612 | 9/1973 | Fed. Rep. of Germany | 336/208 |
| 2838174 | 3/1980 | Fed. Rep. of Germany | 336/208 |
| 3433700 | 3/1986 | Fed. Rep. of Germany . | |
| 2422236 | 12/1979 | France | 336/208 |
| 2199700 | 7/1988 | United Kingdom . | |

*Primary Examiner*—Thomas J. Kozma

*Attorney, Agent, or Firm*—Dennison, Meserole, Pollack & Scheiner

[57] ABSTRACT

An ignition coil comprises at least one magnetic assembly, each of which has a central magnetic core, around which two formers, namely a primary and a secondary former, are arranged coaxially. The formers carry the primary and secondary windings respectively, and the magnetic assembly further includes retaining means adapted to position and secure the primary former within the secondary former. These retaining means comprise steps formed integrally in a tubular cavity of the secondary former and cooperating with one of the end plates of the primary former.

2 Claims, 2 Drawing Sheets

IGNITION COIL, IN PARTICULAR FOR AN INTERNAL COMBUSTION ENGINE OF AN AUTOMOTIVE VEHICLE, AND MEANS FOR RETAINING THE PRIMARY ASSEMBLY WITHIN THE SECONDARY ASSEMBLY OF SUCH A COIL

FIELD OF THE INVENTION

The present invention is concerned with an ignition coil, in particular for an internal combustion engine of an automotive vehicle.

Such a coil includes, in general terms, at least one magnetic assembly of the closed circuit type, with each magnetic assembly comprising a central magnetic core around which two formers of plastics material are coaxially disposed, with each former carrying a respective primary or secondary winding, the said magnetic assembly or assemblies being mounted in a casing of plastics material moulded around a magnetic flux return circuit which constitutes the metallic armature of the casing. A synthetic resin, flowed into the interior of the casing, encapsulates and insulates electrically from each other the various elements constituting the ignition coil.

BACKGROUND OF THE INVENTION

In such ignition coils, it is well known that, because the secondary circuit produces a very high electrical voltage, it is necessary to provide, between the secondary winding and all other metallic elements of the coil, a gap which is sufficient to give the largest possible high tension paths, so as to avoid the occurrence of an electric arc between the secondary winding and any of the other above mentioned metallic elements.

This problem is especially hard to overcome in existing types of ignition coil, since the primary and secondary windings are arranged coaxially on the central magnetic core. Thus, during assembly of the coil, the fitting of the primary assembly into the secondary assembly must be carried out very precisely, in order that the spacing in all directions between the primary and the secondary will be of exactly the correct dimensions.

Another problem that has to be overcome is that of how to retain the primary assembly in place in the secondary in such a way that, when the resin is being injected into the casing, the primary assembly remains securely in position with respect to the secondary assembly.

Finally, the fitting and securing of the primary assembly needs to be carried out in as simple a way as possible, so as to satisfy the economic requirements of mass production of such coils.

SUMMARY OF THE INVENTION

The present invention aims to overcome the above mentioned problems. Therefore, in accordance with the invention, an ignition coil comprising at least one magnetic assembly, each of which comprises a central magnetic core around which are coaxially disposed two formers, namely a primary former and a secondary former, carrying respectively the primary winding and the secondary winding, together with retaining means adapted to position and secure the primary former within the secondary former, is characterised in that the retaining means comprise a plurality of steps, formed integrally in a tubular cavity of the secondary former and cooperating with one of the end plates of the primary former.

In accordance with a preferred feature of the invention, the said retaining means are associated with complementary means comprising a plurality of bosses, formed integrally on the other end plate of the primary former and having a projecting portion which cooperates with recesses formed integrally on the end plate of the secondary former.

The description which follows, and which is given with reference to the accompanying drawings briefly described below, will afford a better understanding as to how the invention may be carried out in practice.

It should be noted that, although the invention is described below, and shown in the drawings, in the specific context of a multiple ignition coil comprising two magnetic assemblies of the kind described above, the invention may perfectly well be applied to an ignition coil of, for example, the single output type in which there is only one magnetic assembly.

DESCRIPTION OF A PREFERRED EMBODIMENT OF THE INVENTION

Figure 1:
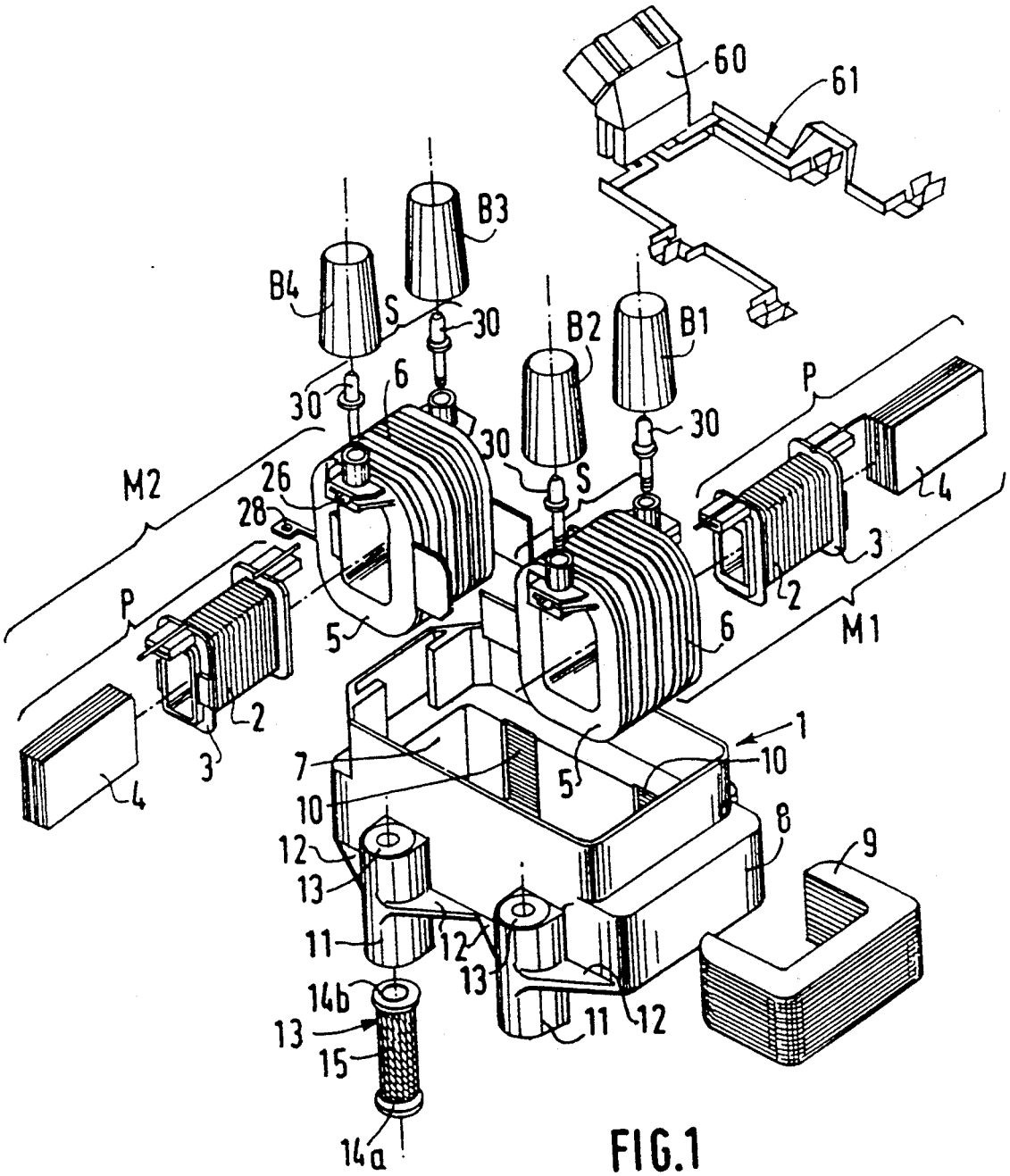
FIG. 1 is an exploded view of the various components of a double ignition coil in accordance with the invention.

FIG. 1 is an exploded view of the various elements of an ignition coil 1 for an internal combustion engine of an automotive vehicle. In the example shown, the coil is arranged for supplying the four spark plugs corresponding to the four cylinders of the engine. Accordingly, it is a double coil comprising two separate but identical magnetic circuits M1 and M2. Each of these magnetic circuits is a closed circuit, and includes a primary winding 2 which is wound on a primary former 3. A central magnetic core 4, having a rectangular profile and consisting generally of magnetic laminations, formed by pressing and stacked together, is mounted within the former 3.

Around each of these assemblies (which we will call the primary assembly P) there is disposed a secondary former 5, around which a secondary winding 6 is wound. We will call this a secondary assembly S. Each secondary assembly S is maintained in position on and around the primary assembly P.

Four output terminals B1, B2, B3 and B4 are disposed on the secondary assemblies S. Each of these output terminals is adapted to be connected in a conventional way, through an appropriate cable, to a spark plug associated with each cylinder of the engine. Each high tension terminal B1, B2, B3 or B4 includes a high tension terminal pin 30 which is secured by being screwed into a connecting strip 28, the latter having been inserted beforehand into a slot. The end of the secondary winding is soldered to one end of the connecting strip 28. The low tension connection is obtained by means of a connection assembly comprising a preformed connecting strip member 61 which is inserted into a connector 60.

When the primary assemblies P have been assembled into the secondary assemblies S, the two magnetic circuits M1 and M2, thus constructed, are introduced into the housing cavity 7 of a casing 8 made of insulating material. For each magnetic assembly M1, M2, a magnetic flux return circuit 9, generally of U shape and comprising a stack of pressed out magnetic laminations, is incorporated by moulding into the casing 8. After moulding, only the rectangular surfaces 10 of these laminations, which lie facing each of the magnetic cores 4 of the primary assembly P, are exposed. The magnetic flux return circuits 9 therefore constitute the metallic armature of the casing 8. External bosses 11, which are connected through ribs 12 to the casing 8, are formed integrally with the latter during its moulding. Metal inserts 13 are located in the bosses 11, and together with the latter these constitute the means for securing the coil assembly to the vehicle itself.

Figure 3:
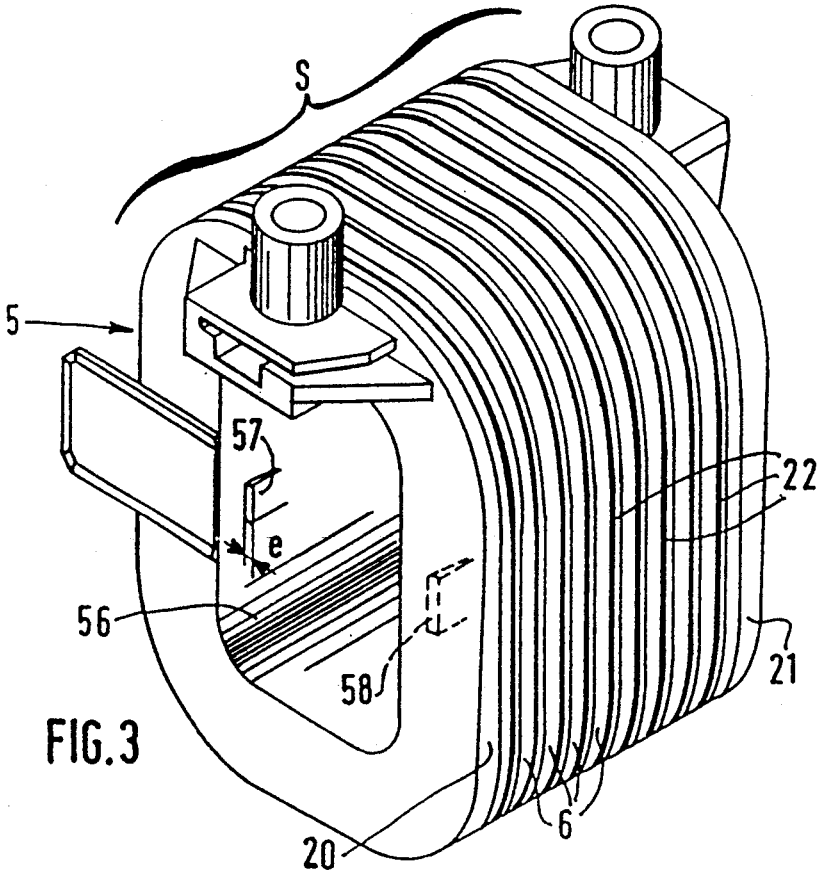
FIG. 3 is a perspective view of the secondary assembly, on a larger scale still.

Reference is now made to FIG. 3, which shows the secondary assembly S including the former 5. The latter is formed by moulding in plastics material and includes, at each of its ends, an end plate 20, 21. Over the whole of the outer periphery of the tubular central part of the secondary former 5, the former is sub-divided into compartments by discs 22. Two wires are wound on the former 5 to constitute the secondary windings 6. The discs 22 allow the wires constituting the windings 6 to be wound to give a winding having a substantial thickness. In addition, the secondary former 5 defines within it a tubular cavity 56 for receiving the primary assembly P. Two steps 57 and 58, the thickness e of which varies progressively over their length, are formed integrally inside the cavity 56.

Figure 2:
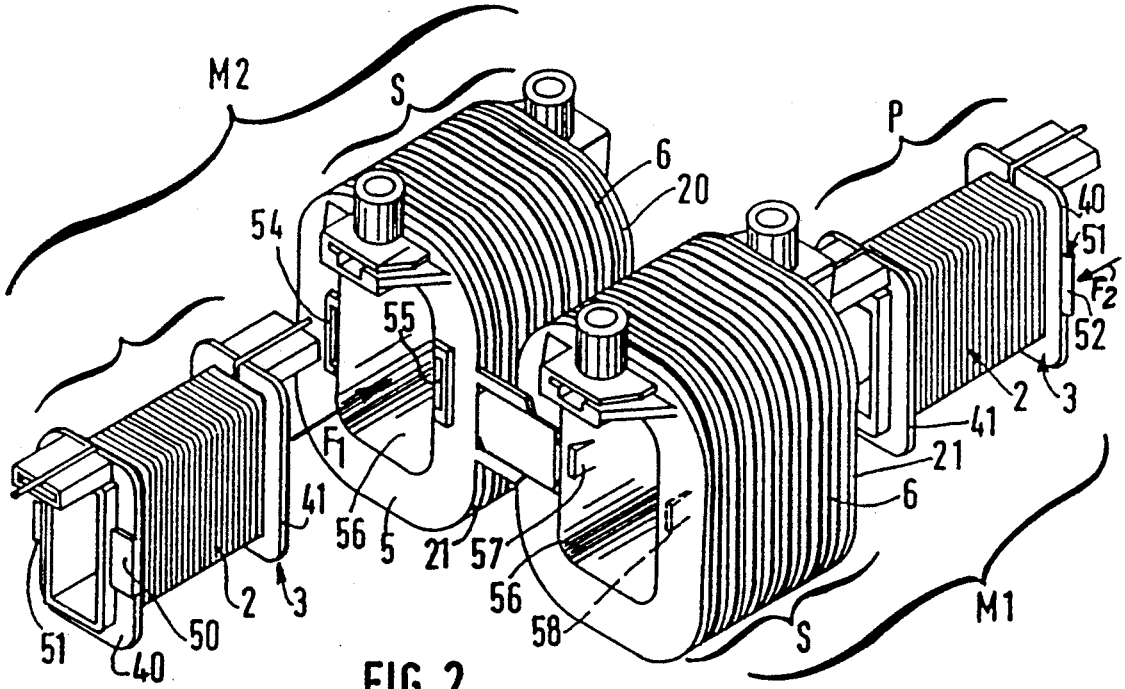
FIG. 2 is an exploded view on a larger scale, showing the two magnetic assemblies of the same coil before being assembled.

Reference is now made to FIG. 2, in which each primary assembly P is shown ready to be assembled into the corresponding secondary assembly S, by insertion into the latter in the direction indicated by the arrow F1 and F2.

Each primary former 3 has to end plates 40 and 41. Two bosses 50 and 51, generally rectangular in shape and each having a lateral projecting portion 52, are formed integrally with the end plate 40. The bosses 50 and 51 are complementary to each other, each being formed on a respective one of the vertical walls of the end plate 40. Two recesses 54 and 55 are formed integrally on the end plate 21 of the secondary former 5.

During the introduction of the primary assembly P into the tubular cavity 56 of the secondary former 5, for example in the direction indicated by the arrow F2, the walls of the end plate 41 of the primary former 3 are guided into the cavity 56 by the walls of the latter, and then pass between, and in close contact with, the steps 57 and 58, due to their elasticity until the steps, then acting as end stops, prevent further translational movement of the primary assembly P. At the same time, once the primary assembly P is introduced into the secondary assembly S, for example in the direction indicated by the arrow F1, the projecting portions 52 of the bosses 50 and 51 of the end plate 40 of the primary former 3 come into nesting engagement in the recesses 54 of the end plate 21 of the secondary former 5. In this way, the primary assembly P is positioned precisely in the secondary assembly S, with the former being then immobilised within the latter.

The invention is not limited to the embodiment described and shown above, and may be made with any desirable modifications without thereby departing from the scope of the present invention.

What is claimed is:

1. An ignition coil assembly comprising:

at least one magnetic circuit including a primary and a secondary assembly, said primary assembly including a tubular former defining a first tubular cavity, an end plate positioned at each end thereof, a winding extending around said primary former between said end plates, and a central magnetic core mounted within the first tubular cavity and positioned between said end plates, said secondary assembly including a tubular former defining a second tubular cavity, an end plate at each end thereof, a secondary winding extending around said secondary former, aligning step means integrally formed on the inside of said secondary former and projecting into said second tubular cavity for engaging and aligning said primary assembly within said secondary assembly, said aligning step means including a plurality of wedge-shaped steps oppositely positioned on the inside of said secondary former, each of said wedge-shaped steps including a head portion adjacent one of said secondary end plates, said secondary cavity receiving said primary assembly with one of said primary end plates nesting within said wedge-shaped steps to position said primary assembly within said secondary assembly and in spaced relation thereto, and to prevent further translational movement of said primary assembly within said secondary assembly.

2. An ignition coil according to claim 1, wherein the retaining means further comprise a plurality of bosses formed integrally on the other end plate of the primary former and having portions projecting laterally from the latter, one of said end plates defining integral recesses therein for cooperating with the laterally projecting portions of the said bosses when the primary former is located in the secondary former.

* * * * *